US009115522B2

(12) United States Patent
Sofianek et al.

(10) Patent No.: US 9,115,522 B2
(45) Date of Patent: Aug. 25, 2015

(54) SIDE LOAD CONSTANT FORCE COUNTERBALANCE SYSTEM

(71) Applicant: Caldwell Manufacturing Company North America, LLC, Rochester, NY (US)

(72) Inventors: Jay Sofianek, Webster, NY (US); Patrick Milligan, Rochester, NY (US); Allen Feltes, Rochester, NY (US); Alan Jakus, Hemlock, NY (US)

(73) Assignee: Caldwell Manufacturing Company North America, LLC, Rochester, NY (US)

( * ) Notice: Subject to any disclaimer, the term of this patent is extended or adjusted under 35 U.S.C. 154(b) by 0 days.

(21) Appl. No.: 13/919,534

(22) Filed: Jun. 17, 2013

(65) Prior Publication Data

US 2013/0333293 A1 Dec. 19, 2013

Related U.S. Application Data

(60) Provisional application No. 61/660,433, filed on Jun. 15, 2012, provisional application No. 61/660,355, filed on Jun. 15, 2012.

(51) Int. Cl.
*E05D 13/00* (2006.01)

(52) U.S. Cl.
CPC ..... *E05D 13/12* (2013.01); *E05D 13/1276* (2013.01)

(58) Field of Classification Search
CPC ..... E05D 13/00; E05D 13/10; E05D 13/12; E05D 13/1276; E05D 13/1284; E05D 13/1292; E06B 7/00; E05B 17/0012
USPC ..... 49/61, 63, 125, 127, 128, 445, 446, 49/380; 206/325
See application file for complete search history.

(56) References Cited

U.S. PATENT DOCUMENTS

| | | | | |
|---|---|---|---|---|
| 354,162 | A | 12/1886 | McArthur | |
| 403,479 | A * | 5/1889 | McArthur | 16/198 |
| 979,014 | A * | 12/1910 | Lippincott | 16/206 |
| 2,807,838 | A * | 10/1957 | Perry | 49/423 |
| 2,941,237 | A * | 6/1960 | Reese | 16/197 |
| 3,284,954 | A * | 11/1966 | Hayman | 49/423 |
| 6,857,228 | B2 | 2/2005 | Kunz et al. | |
| 6,860,066 | B2 | 3/2005 | Kunz et al. | |
| 6,990,710 | B2 | 1/2006 | Kunz et al. | |
| 7,980,028 | B1 | 7/2011 | Kunz | |
| 8,181,396 | B1 | 5/2012 | Kunz | |
| 8,448,296 | B2 * | 5/2013 | Kellum, III | 16/193 |
| 8,458,878 | B1 | 6/2013 | Kunz | |
| 8,505,242 | B1 | 8/2013 | Kunz | |

* cited by examiner

*Primary Examiner* — Katherine Mitchell
*Assistant Examiner* — Catherine A Kelly
(74) *Attorney, Agent, or Firm* — Harness, Dickey & Pierce, P.L.C.

(57) ABSTRACT

A side load constant force window balance assembly is disclosed. The balance assembly has a spring member, a spring housing, and a carrier module. The spring housing and carrier module are coupled to the spring member. The carrier module is configured to support a portion of a window sash and has an engagement feature configured to selectively engage the window frame.

26 Claims, 17 Drawing Sheets

92
30
91

92
30
94

92
91
30

30
94
110

30
91

91
92
30

92
96
98
94
110
110

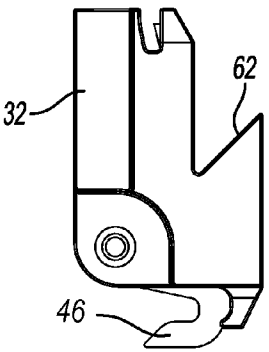
Fig-11A
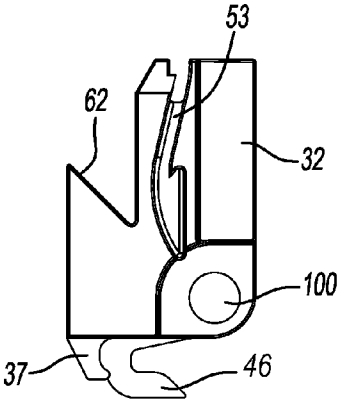
Fig-11B
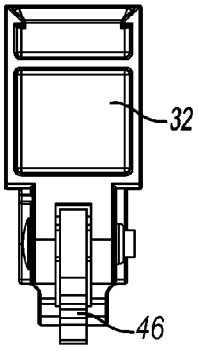
Fig-11C
Fig-11D
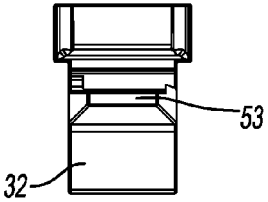
Fig-11E
Fig-11F
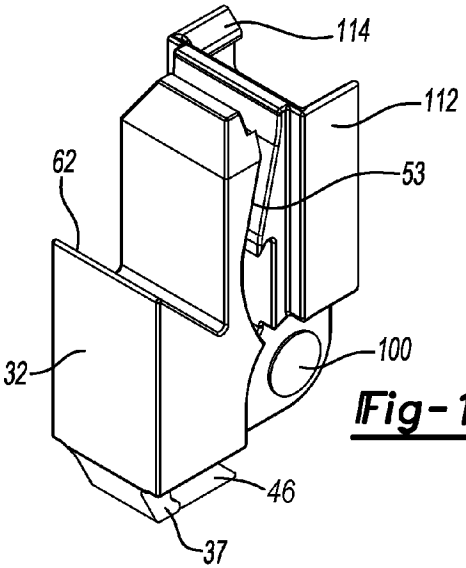
Fig-11G

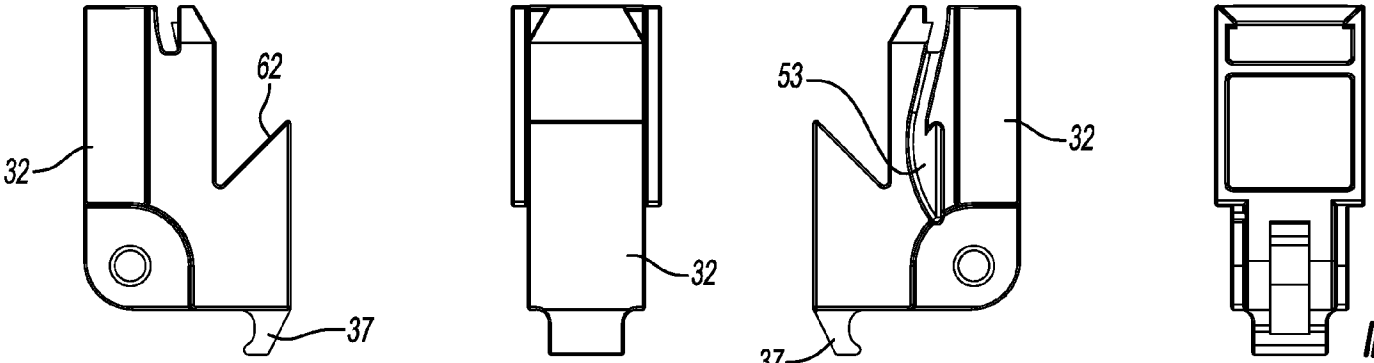
Fig-12A
Fig-12B
Fig-12C
Fig-12D
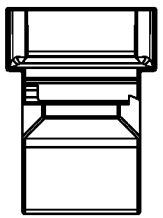
Fig-12E
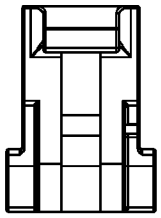
Fig-12F
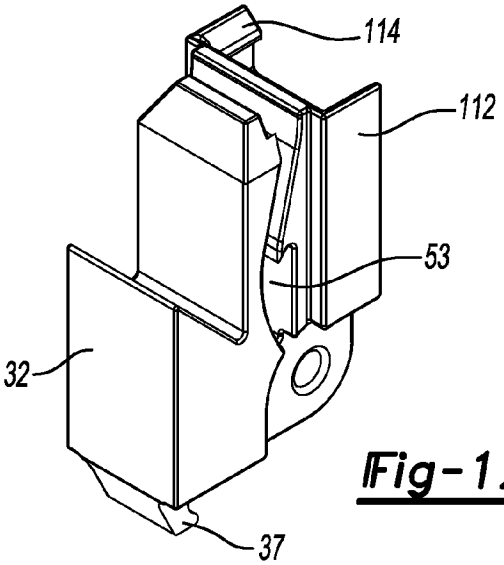
Fig-12G

SIDE LOAD CONSTANT FORCE COUNTERBALANCE SYSTEM

CROSS-REFERENCE TO RELATED APPLICATIONS

This application claims the benefit of U.S. Provisional Application No. 61/660,433, filed on Jun. 15, 2012 and U.S. Provisional Application No. 61/660,355, filed on Jun. 15, 2012. The entire disclosure of the above applications is incorporated herein by reference.

FIELD

The present teachings relate to a coil spring counter balance assembly for a window and, more particularly, to a fixed spring counter balance assembly for a movable sash window.

BACKGROUND

A window assembly generally includes a window frame, at least one sash, and a pair of opposing window jambs with each jamb having a channel for allowing the vertical travel of the sash. The sash is attached to a balance which assists with the raising and lowering of the sash by providing a force to counterbalance the weight of the sash.

The jambs are part of the window frame and are positioned on either side of the sash. The jamb channels must provide adequate clearance to permit the sash support, also known as a carrier, to freely traverse up and down within them. The movement of the sash with respect to a fixed spring assembly causes friction and can damage internal surfaces within the channel. This permits detritus from the damaged channel to flow through the jamb channel to impair the movement of the sash and interfere with a spring support mechanism.

Windows are subject to manufacturing guidelines that specify air flow standards for various designs. For example, there are a variety of standards which apply depending upon the region of the country to which the window is to be shipped for installation. Not only must the sash panes be able to structurally withstand high air pressures, but the various moving elements of each window frame must be able to move freely.

Previous attempts to alleviate the problem with springs and counterbalance assemblies within the jamb channels of window frames have failed to achieve the desired result. What is needed is a structure that successfully achieves the goal of reducing the amount of interaction between the spring and sash that is within a jamb channel. This objective preferably would be achieved while not increasing friction which might add to the burden of moving the sash up and down through the jamb channel.

SUMMARY

The present invention relates to a counter balance system for a window sash within a window frame. The system has a spring counter balance with a cassette having a coiled spring disposed therein. The cassette is configured to be selectively fixably couple to the window frame. Coupled to a movable end of the coiled spring is a window sash support member. The window sash support member is movable from a first window support location to a second window support location. The window support member has a locking feature configured to be rotated from a first position to a second position, wherein in the second position, the locking feature is disposed within a hole defined within the window frame. The hole has a bearing surface which engages the locking feature. In one embodiment, the window sash support member has a rotatable flange having a locking protrusion which holds the locking feature in a non-engaged position.

According to another embodiment, the rotatable flange has an engageable member which is configured to accept forces to move the locking feature from a non-engaged position to an engaged position.

According to another embodiment, the rotatable locking feature has a pair of rotatable flanges which interact with first and second surfaces in the frame.

According to the above embodiment, the support member includes a translatable member configured to engage the rotatable member and move the first and second rotatable flanges from unengaged to engaged positions.

BRIEF DESCRIPTION OF THE FIGURES

FIGS. 11A-12G represent views of a sash support member according to the present teachings;

DETAILED DESCRIPTION OF THE DRAWINGS

Although the present teachings show counter balance in a single hung sash, the teachings herein are equally applicable to double hung windows.

Figure 1C:
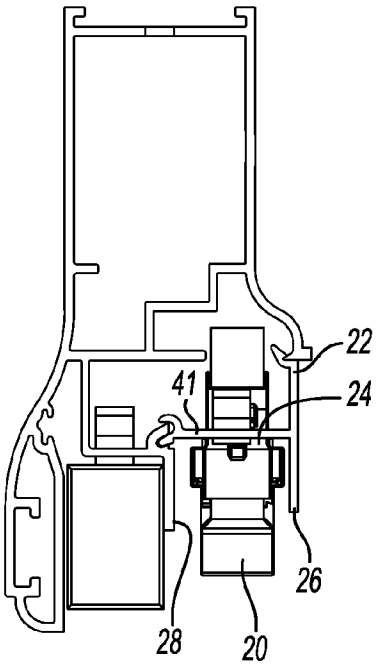
FIGS. 1A-1C represent a spring counter balance for a removable sash installation according to the present teachings.
Figure 1B:
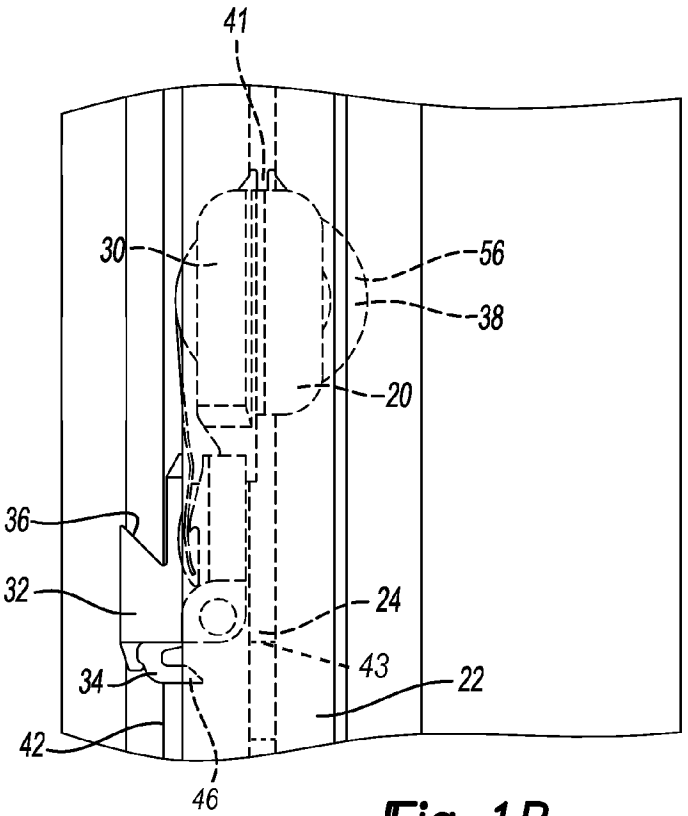
Figure 1A:
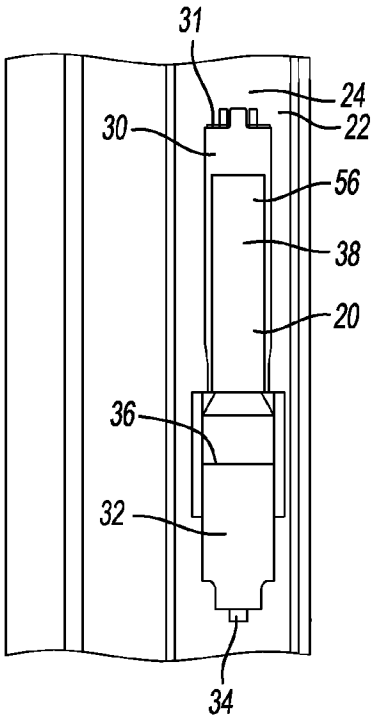
Figure 2C:
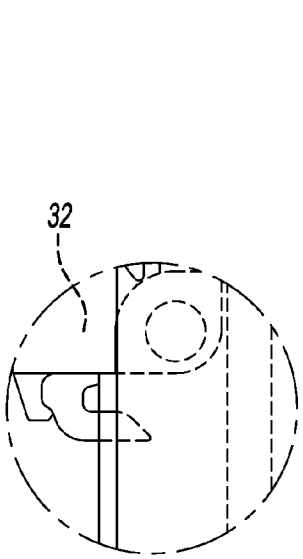
FIGS. 2A-2C represent the spring counter balance shown in FIGS. 1A-1C in a stowed position.
Figure 2B:
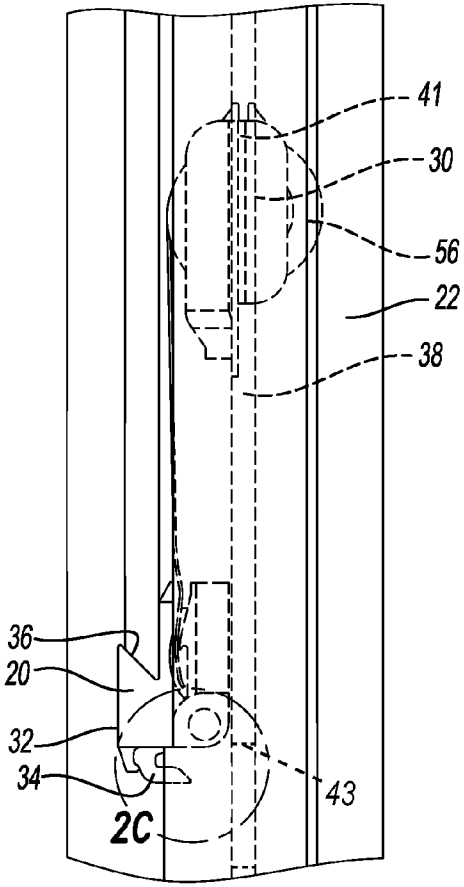
Figure 2A:
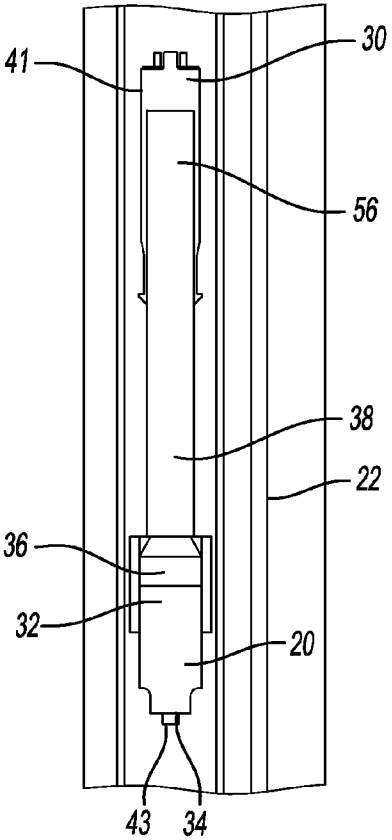

Referring to FIGS. 1A-1C, there is shown a window assembly. The window assembly has a frame 22 which slidably supports a sash (not shown). To prevent the effects of gravity on the sash, a spring counter balance 20 is provided. The spring counter balance 20, which is shown in a retracted position, is coupled to the window frame 22 and provides forces to support the sash.

The spring counter balance 20 is positioned within the frame 22, and is fixably coupled to a first bearing surface 24. In this regard, a portion of the spring counter balance 20 is positioned within a carrier aperture 41 defined within the first bearing surface 24. As seen in FIG. 1C, the spring counter balance 20 is disposed between channel forming surfaces 26, 28. As will be described in more detail below, the spring counterbalance 20 can be fixed within the aperture 41 using flanges and/or one or more fasteners.

The spring counter balance 20 is generally divided into three members: the spring housing 30, the spring 38, and the carrier module or sash support 32. The spring housing 30 is positioned within the carrier aperture 41, functions to couple the spring 38 to the first bearing surface 24 and, as described below, has features to facilitate the coupling and reduce the profile of the spring counter balance 20. The spring counter balance 20 defines an internal compartment which surrounds and rotationally supports the coil spring 38. The compartment generally supports the spring coil 56 in a manner to allow the spring 38 to be fixed at a first end within the spring housing. A portion of the spring 38 can rotate within the housing on a curved bearing surface to allow extraction of the spring during movement of the sash.

Figure 3C:
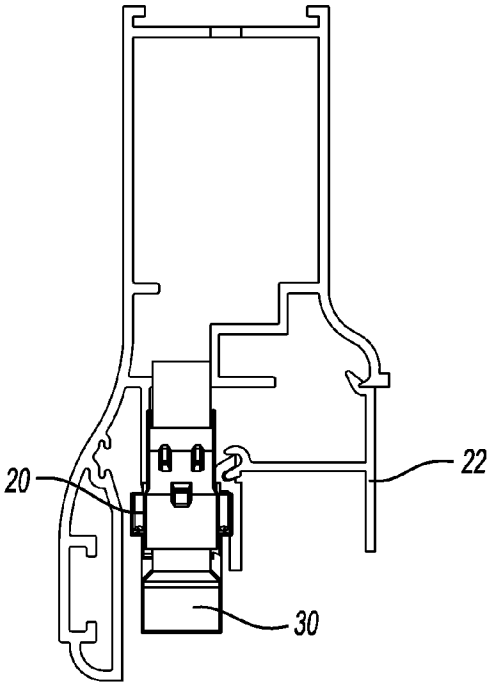
FIGS. 3A-3C represent views of the spring counter balance shown in FIGS. 2A-2C in a removed position according to the present teachings.
Figure 3B:
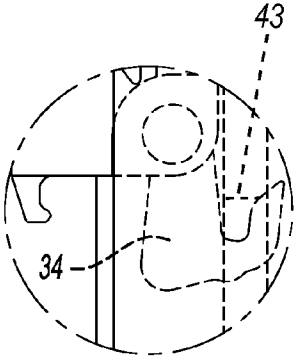
Figure 3A:
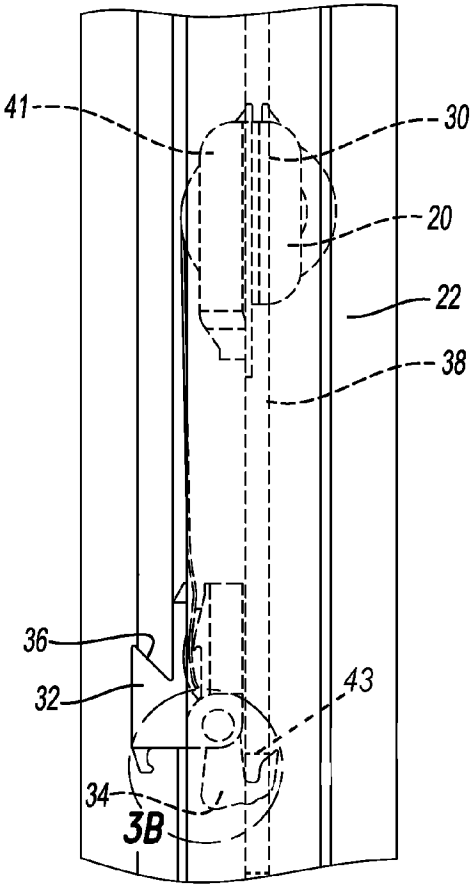
Figure 14:
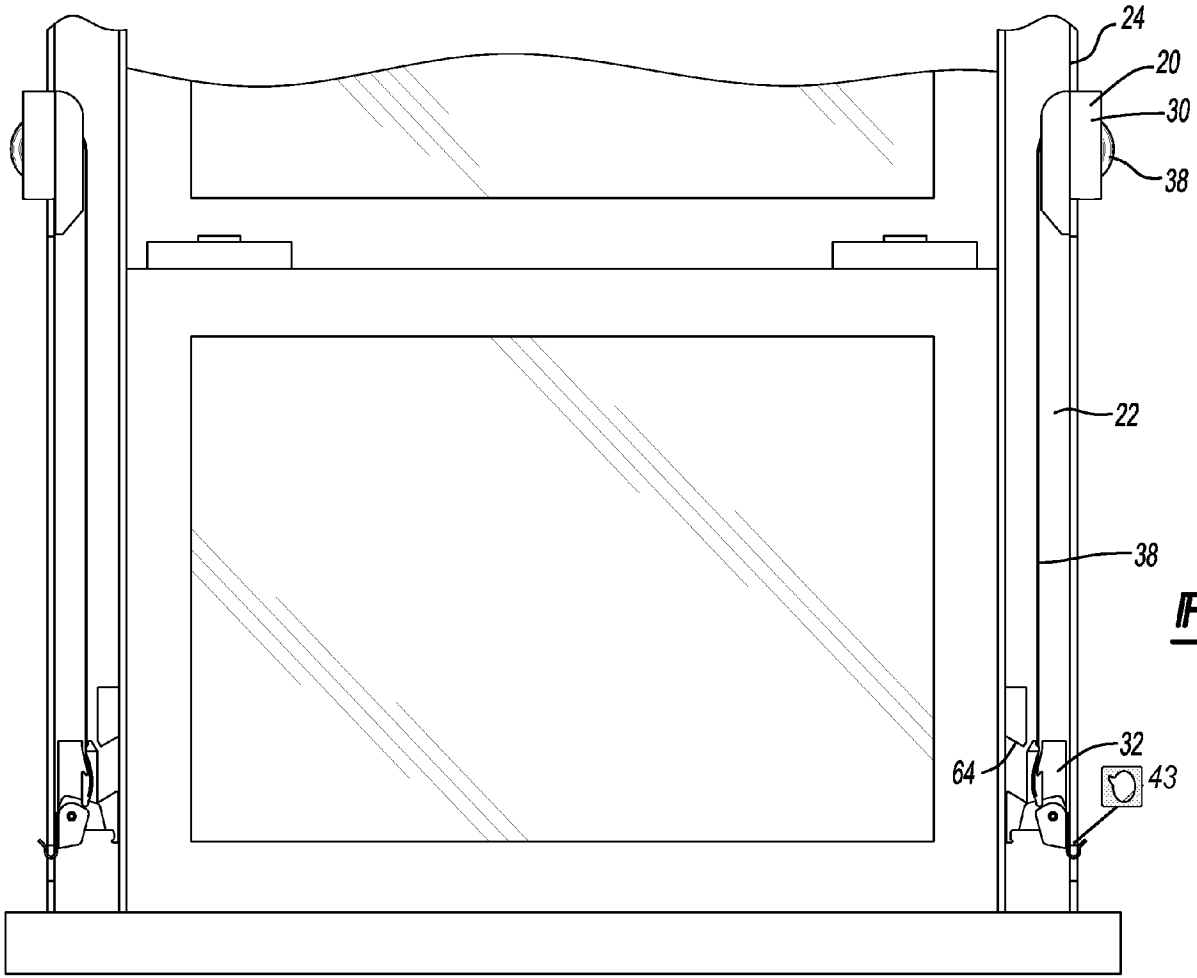
FIG. 14 depicts a window assembly having a movable sash and counter balance spring.

A second end of the spring 38 is fixably coupled to the sash support 32. The sash support 32 is translatably movable within the frame 22 so as to provide a force onto the sash to overcome the effects of gravity. As shown in FIGS. 2A-3B, the sash support 32 has a locking feature 34 that is movable from a disengaged position (shown in FIGS. 2B and 2C) to an engaged position shown in FIGS. 3A and 3B). In the disengaged position, the sash support 32 is lined up with a frame coupling aperture 43. At the frame coupling aperture 43, a consumer can rotate the locking feature 34 into the frame coupling aperture 43 to selectively lock the sash support 32 to the window frame 22, as best seen in FIG. 3B and FIG. 14. This releases the force of the spring from the sash, thus allowing a consumer to, for example, remove the sash from the frame for cleaning. It is envisioned that there could be a number of frame coupling apertures along the length of the track to allow for selective disengagement of the sash support 32 from the sash.

Figure 4A:
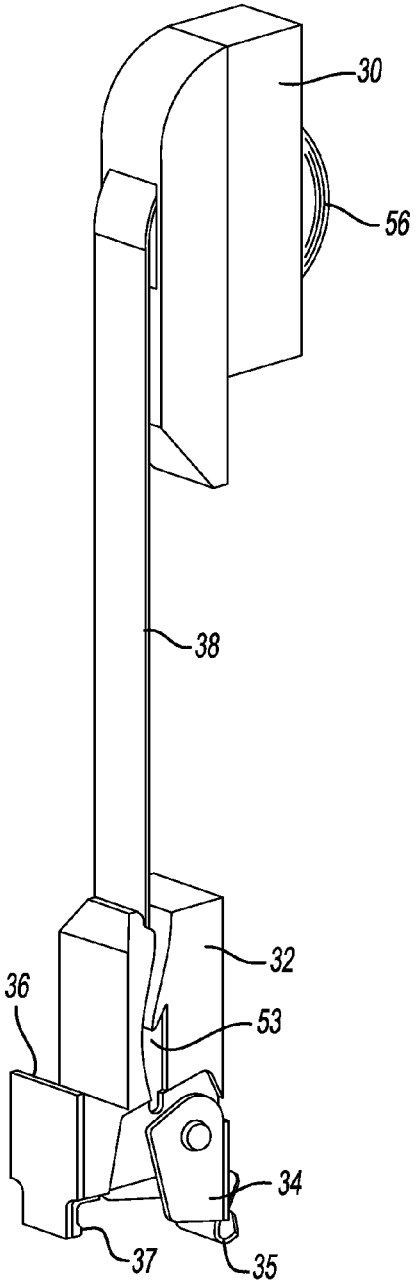
FIGS. 4A and 4B represent perspective and side views of a spring counter balance according to the present teachings.
Figure 4B:
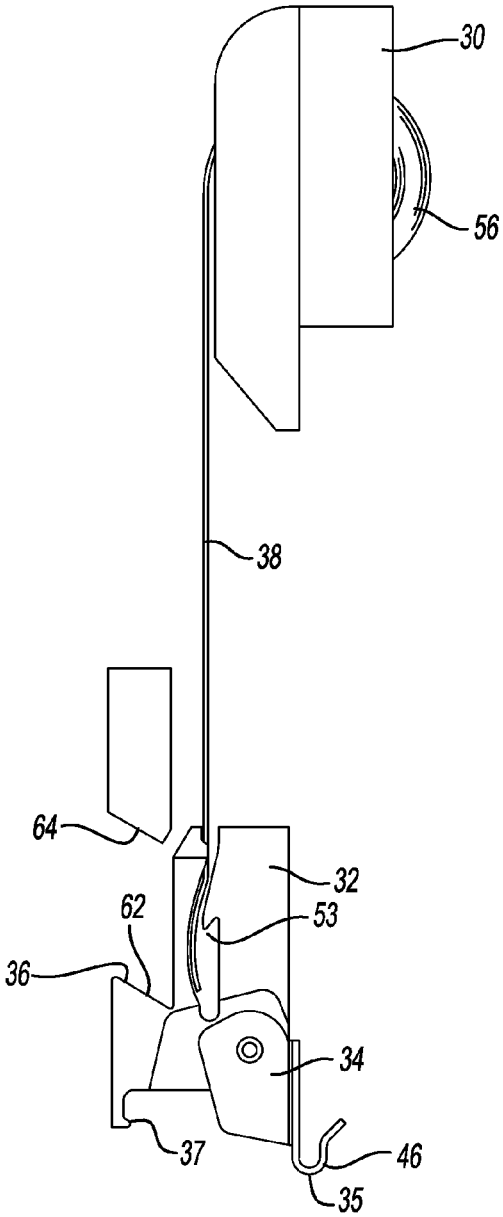

As shown in FIGS. 4A and 4B, the sash support 32 has a sash support feature 36 which engages a coupling surface 64 that forms part of the sash, such as a tab portion that is integrally formed in and protrudes from the frame of the sash. Alternatively, the coupling surface 64 can be formed on a separate component (e.g., a block) that is attached to the frame of the sash. While the coupling surface can take a number of configurations, it is envisioned that the coupling surface 64 can be coplanar or complementary with the surface 62 of the support feature 36 when engaged. The sash support 32 has a spring coupling channel 53 which couples a second end of the spring 38 to the sash support 32. Moreover, It is envisioned other coupling mechanisms such as locking flanges, fasteners, or adhesives could be used to couple the second end of the spring to the sash support 32.

Also shown is an alternate locking feature 34 which has a u-shaped coupling flange configured to surround and couple to a bearing flange on the sash support 32. The u-shaped flange is rotatably coupled to the bearing flange by a pin. The locking feature 34 has a hook 46 which engages the frame coupling aperture 43 formed in the window frame (best seen in FIG. 14). The hook also has an engaging surface 35 that engages a lock 37 on the support sash body. The lock 37 can have a curved engagement surface to interlock with a curved surface on the locking member.

Figure 5A:
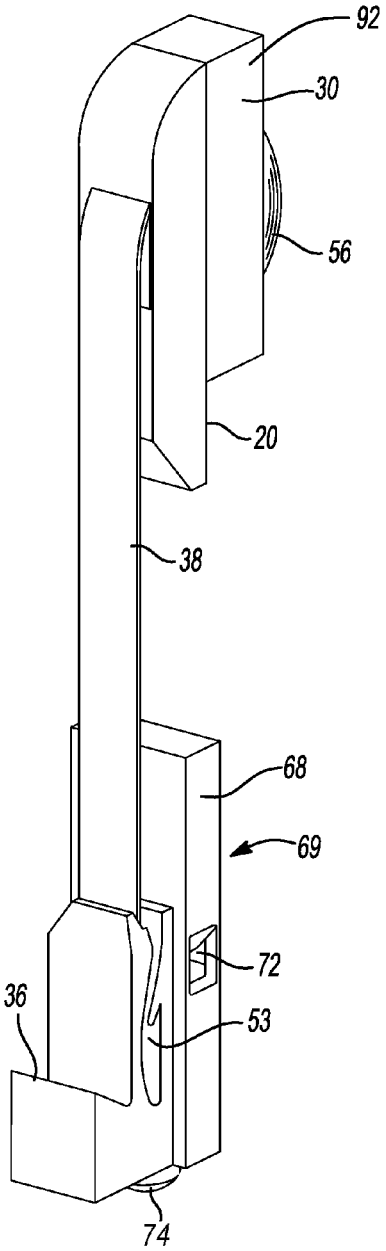
FIGS. 5A and 5B represent perspective and side views of an alternate spring counter balance according to the present teachings.
Figure 5B:
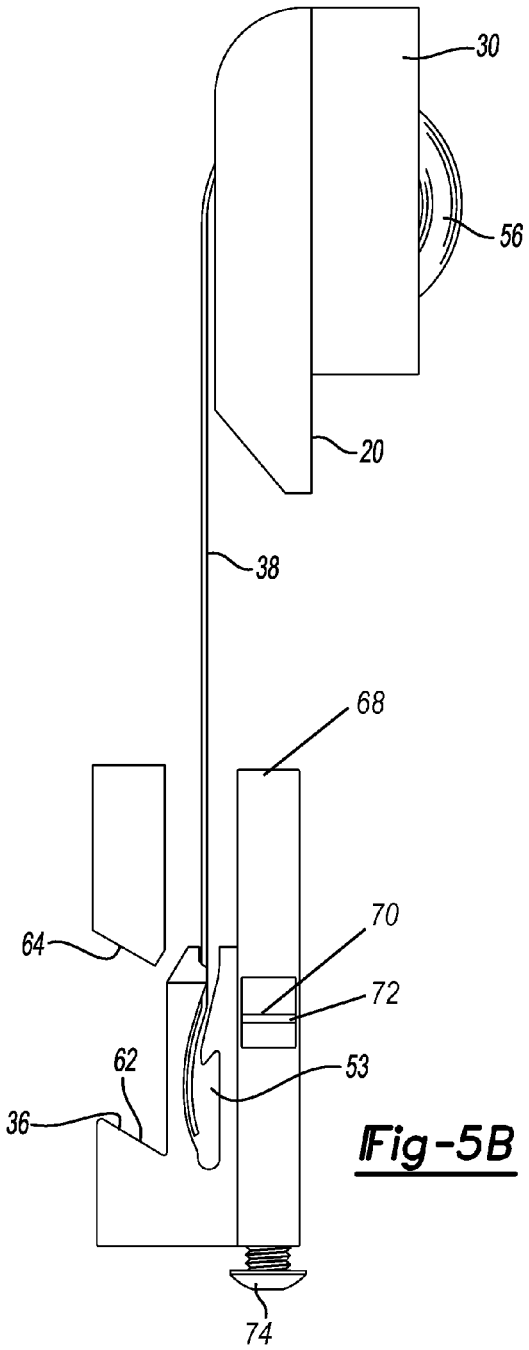

FIGS. 5A and 5B represent views of the spring counter balance 20 according to an alternate teaching. The spring counter balance 20 has an alternate sash support 68 having an alternate locking mechanism 69. The alternate locking mechanism 69 has rotatable members 70 which function to deploy a pair of engagement members 72. The engagement members 72 couple to both the first and second side bearing surfaces 26, 28 of the frame 22. While the side bearing surfaces 26 and 28 are shown generally perpendicular to the first bearing surface 24, it is envisioned that the engagement members 72 could be deployed into an aperture in the bearing surface 24. The engagement members 72 can have textured surfaces to dig into the first and second side bearing surfaces 26, 28.

Figure 6A:
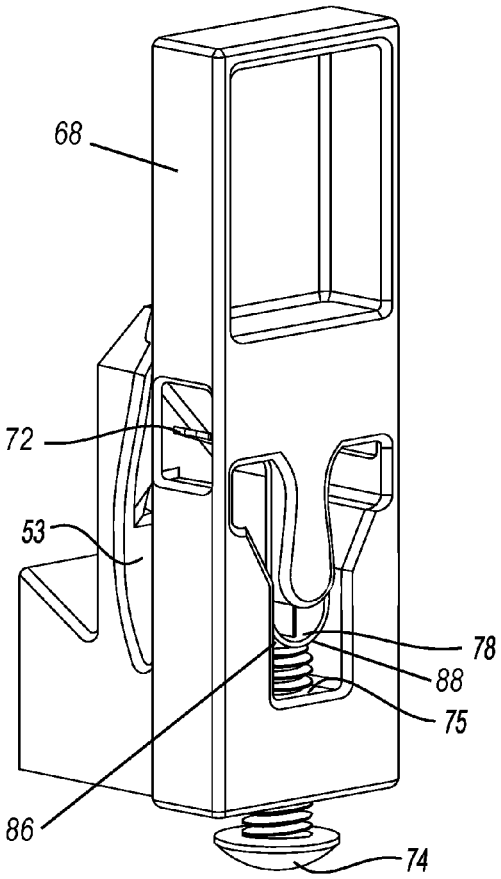
FIGS. 6A and 6B represent perspective and end views of the sash support shown in FIGS. 5A and 5B.
Figure 6B:
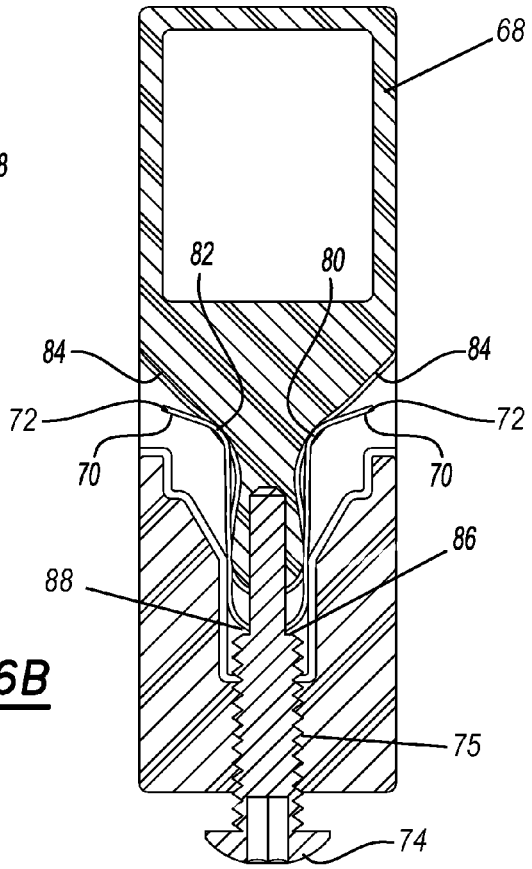

As shown in FIGS. 6A and 6B, the alternate sash support 68 has a pair of rotatable members 70 that can be coupled to a threaded screw 74. The threaded screw 74 is rotatably engaged with a threaded hole 75 within the alternate sash support 68. The pair of rotatable members 70 is coupled to a u-shaped spring metal member 78.

As shown in FIG. 6B, rotation of the screw 74 forces the u-shaped member pair of sloped engaged surfaces 80, 82 into a sloped bearing surfaces 84. The screw 74 can have a bearing surface 86 generally perpendicular to the axis of rotation which engages a bearing surface 88 in the u-shaped spring member 78. Rotation of the screw 74 rotates the rotatable and/or translates members 70 into the window frame. The rotatable or translated members 70 are then frictionally engaged with the frame 22 or are positioned within an aperture defined in the frame. As the u-shaped member 78 is formed of metal such as spring steel, the members 70 are pulled out of the window frame upon reverse rotation of the screw, thus allowing the sash support 68 to move freely within the track.

FIGS. 7A-7G and 8A-8G represent views of single and dual spring counter balance assemblies. As shown, the spring housing 30 can be coupled to the sash support 32 for shipment. Not only are the spring housing 30 and sash support 32 coupled by the spring 38, but components 30, 32 can also be coupled by a selectively engageable locking connection 90. As shown in FIG. 7E and throughout the figures, the selectively engageable locking connection 90 attaches the spring housing 30 and sash support 32 at a removably connectable joint formed by outwardly extending protrusions 110 on the lower portion of the spring housing 30 and a receptacle portion at the upper end of the sash support 32. The receptacle portion can be formed by a plurality of side walls 112 that include inwardly extending retaining members 114 which engage the protrusions 110. The locking connection 90 can be engaged laterally, such as by sliding the side walls 112 and retaining member 114 of the sash support 32 over the protrusions 110 on the lower portion of the spring housing 30. Alternatively, the locking connection 90 can be engaged axially such as by inserting the protrusions 110 on the lower portion of the spring housing 30 into the receptacle portion at the upper end of the sash support 32. Consequently, the locking connection 90 can be engaged to connect the spring housing 30 and sash support 32 during shipping. In addition, the locking connection 90 can be engaged to connect the spring housing 30 and sash support when the sash is in a fully opened condition. It can therefore be appreciated that the locking connection 90 provides supplementary support for the sash when the spring 38 is in a fully retracted condition. On a first surface of the spring housing is a pair of flanges 92 which engage the carrier aperture 41.

Figure 7A:
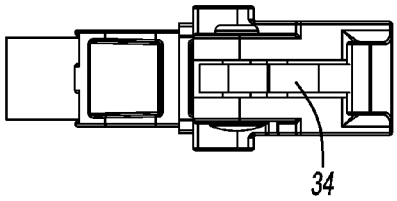
FIGS. 7A-7G represent an alternate spring counter balance according to the present teachings.
Figure 7B:
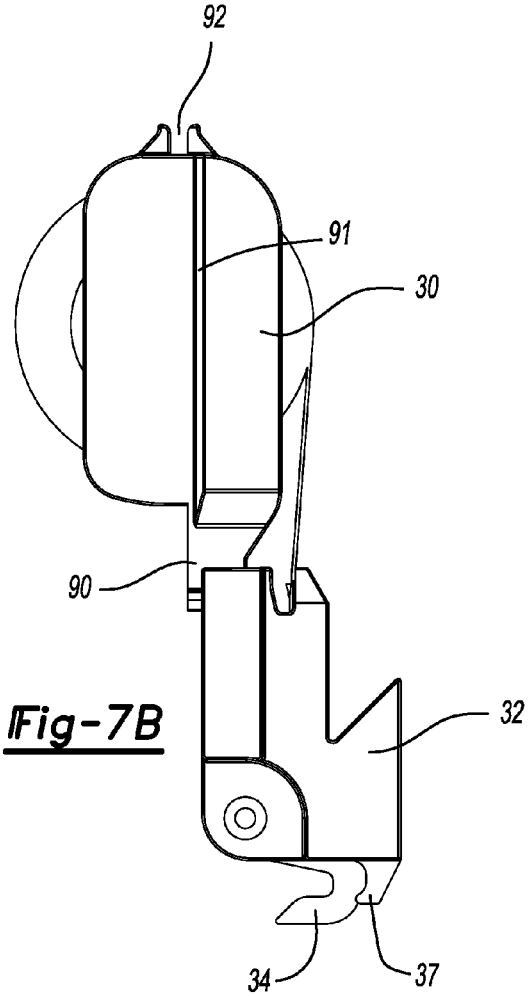
Figure 7C:
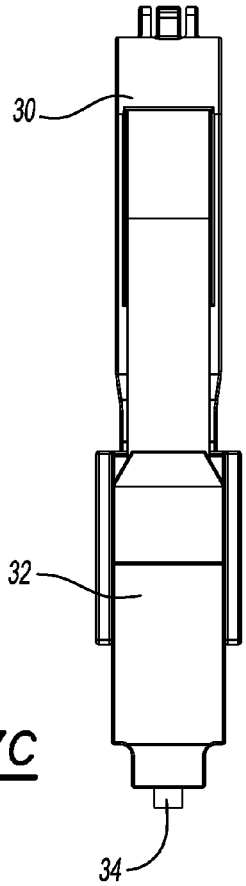
Figure 7D:
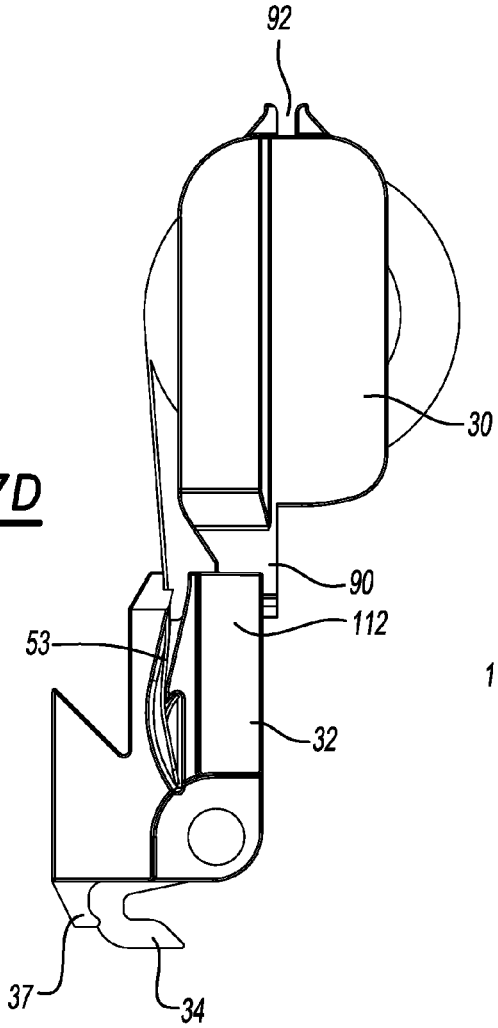
Figure 7E:
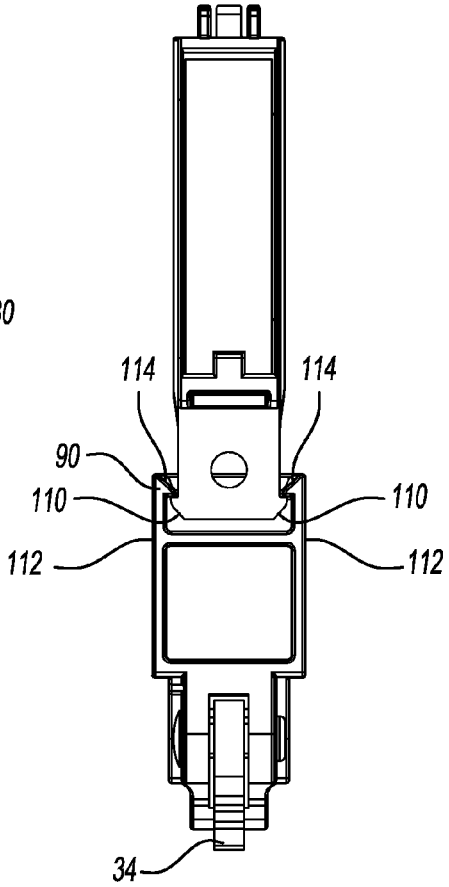
Figure 7F:
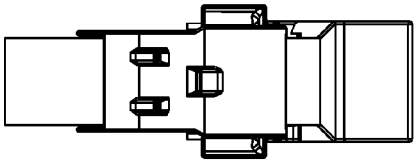
Figure 7G:
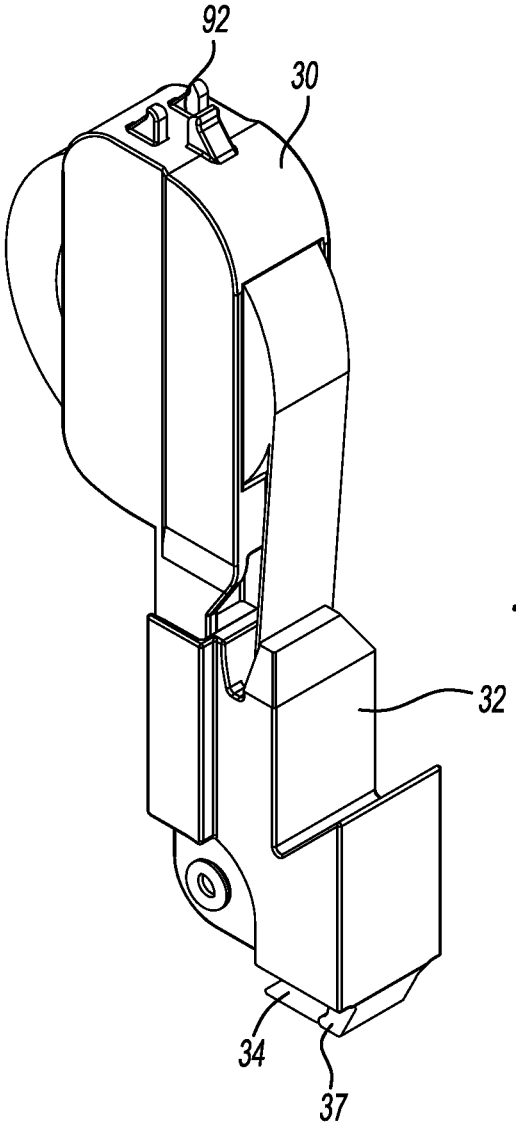
Figure 8A:
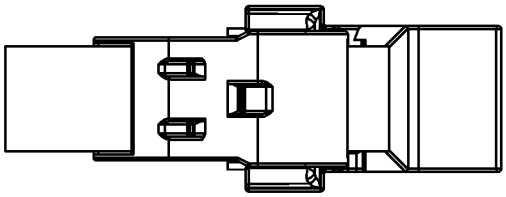
FIGS. 8A-8G represent an alternate spring counter balance according to the present teachings.
Figures 8B, 8C, 8D:
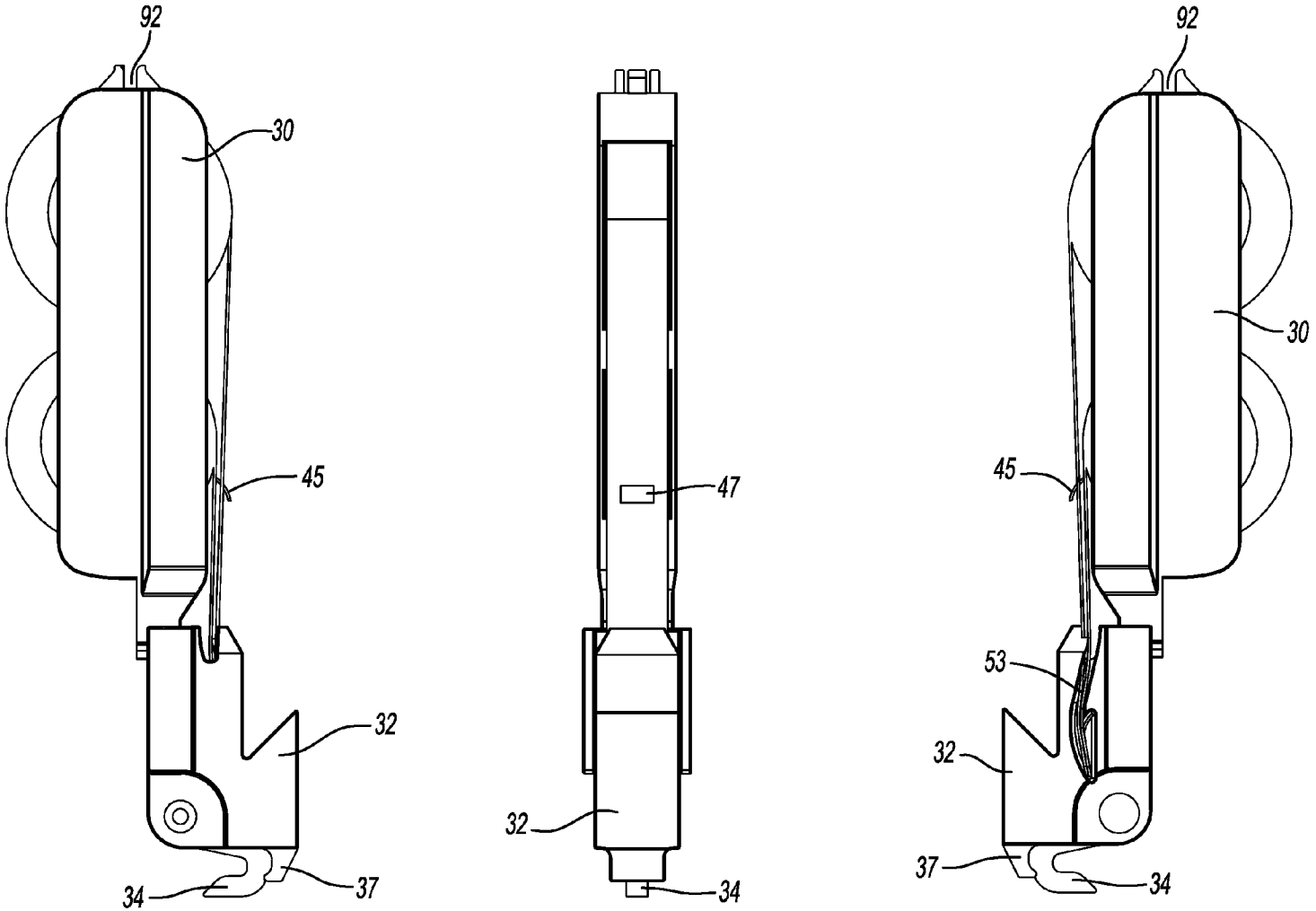
Figure 8G:
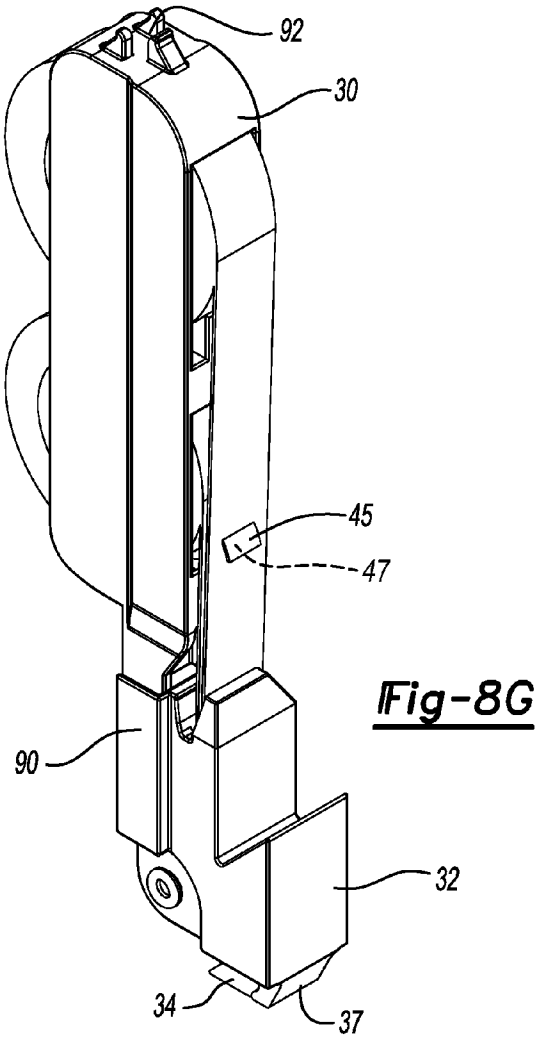
Figure 8F:
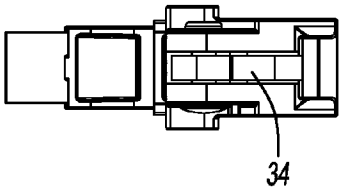
Figure 8E:
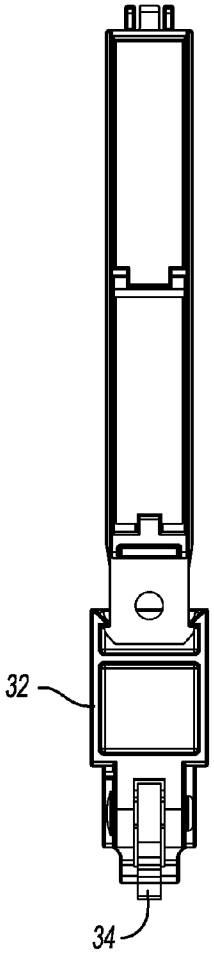
Figures 9A, 9B, 9C, 9D, 9E, 9F, 9G:
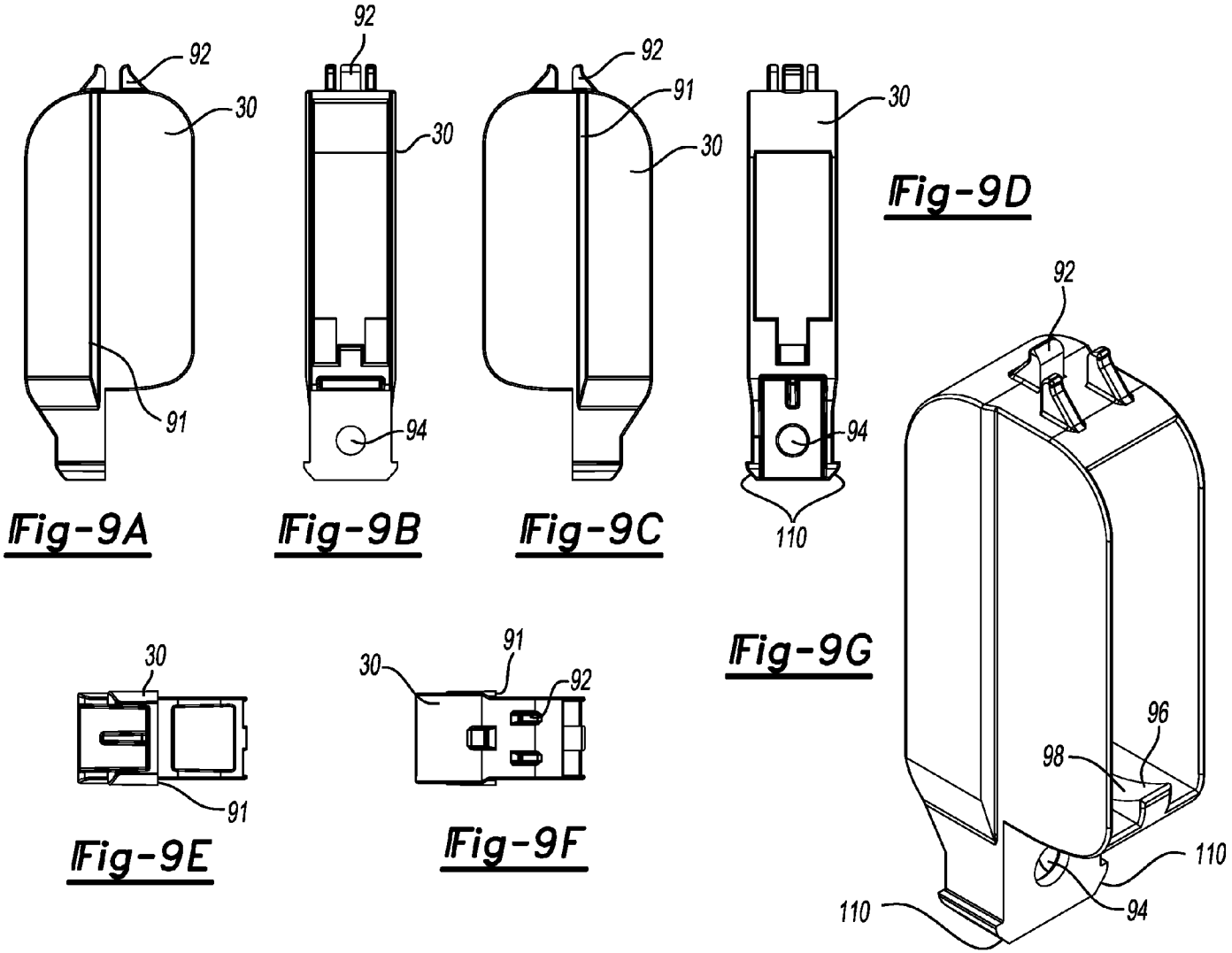
FIGS. 9A-9G represent a spring housing according to the present teachings.

FIG. 7A represents a bottom view of the single spring counter balance assembly. Shown is the location of the locking feature 34 which is rotatably fixed to the sash support 32 via a pin (not shown). The sash support 32 is configured to frictionally support the locking feature 34 into an unexposed position until needed. When a consumer needs to lock the sash support into the frame, the consumer can rotate the locking member about the pin using their finger. Optionally, under gravity, the locking mechanism will rotate into the aperture formed in the frame to lock the sash assembly into position.

FIGS. 7A through 7G represent orthographic and isometric views of the interaction of the spring housing 30 and sash support 32 in their shipping configuration. The locking connection 90 can be uncoupled to allow the fixation of the spring housing 90 to the frame 22. Also shown is a support surface 91 which is configured to bear against the frame 22 when the spring housing is coupled to the frame 22.

FIGS. 8A-8G represent an alternate two spring counter balance 20. The spring support 30 is configured to couple two coiled leaf springs into place. As described above, the springs are rotatably supported in the spring support 30. The second end of both springs can be coupled to the sash support 32 via the slot 53. The springs can be coupled together using a tab 45 from a first spring, which is interleaved with a slot 47 formed in the second spring.

As shown in FIGS. 9A-10C, the spring housing 30 defines a fastener accepting aperture 94 which accepts a fastener to couple the spring housing 30 to the frame 22. Also shown is exemplar coupling flanges 92 which are used to position the spring housing into the aperture defined in the frame surface 24. As best seen in FIG. 9G, the spring housing can define a curved ramp surface 96 on a spring supporting flange 98. The surface facilitates the proper rotation of the coiled spring 38 within the spring housing during extraction or retraction of the spring caused by movement of the sash support 32.

Figure 10C:
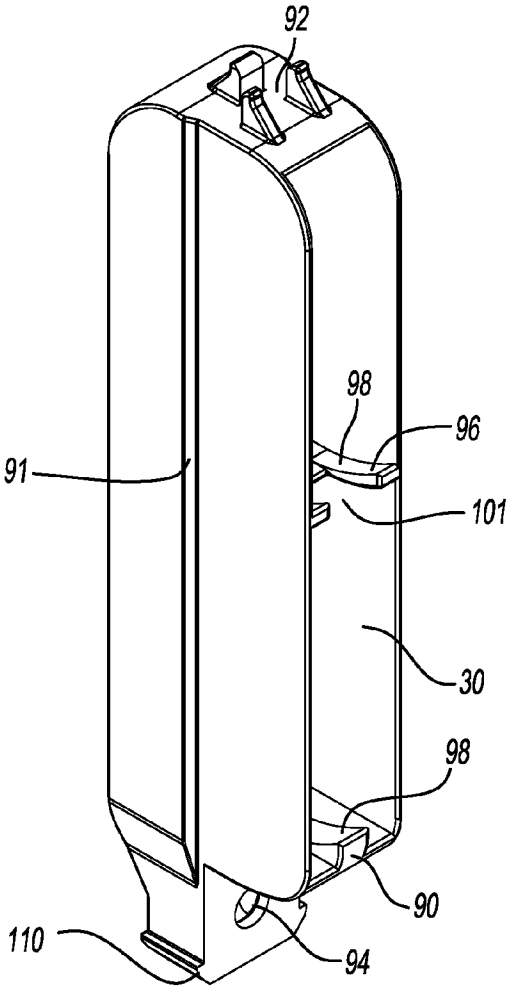
FIGS. 10A-10C represent a second spring housing according to the present teachings.
Figure 10A:
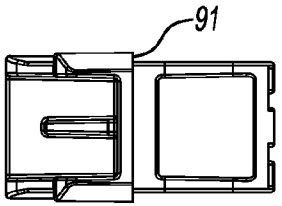
Figure 10B:
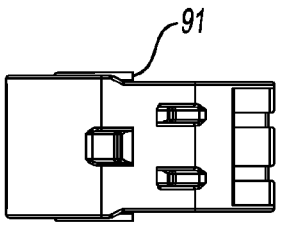

As shown in FIGS. 10A-10C, the two-spring spring housing 30 can have a pair of internal spring support flanges 98 having curved ramped surfaces 96. One of the ramped surfaces 96 can have a slot 101 defined therein to accommodate the movement of the spring 38.

FIGS. 11A-12G represent alternate views of the sash support 32. Shown are the members with and without the locking feature 46 that are held into the sash support using a pin 100.

Figure 13A:
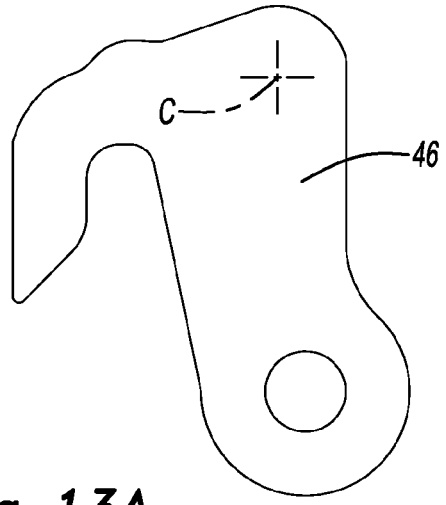
FIGS. 13A-13C represent rotatable hook members used in the sash support members shown in FIGS. 1A-3C.
Figure 13B:
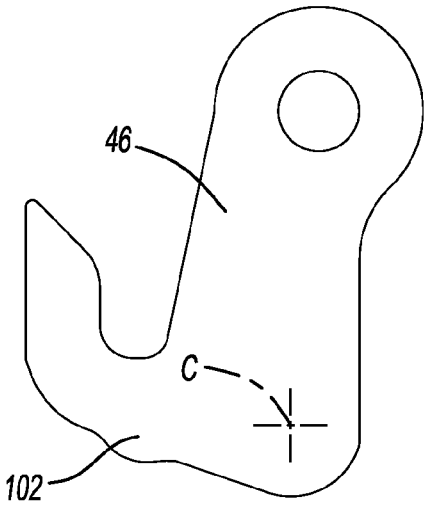
Figure 13C:
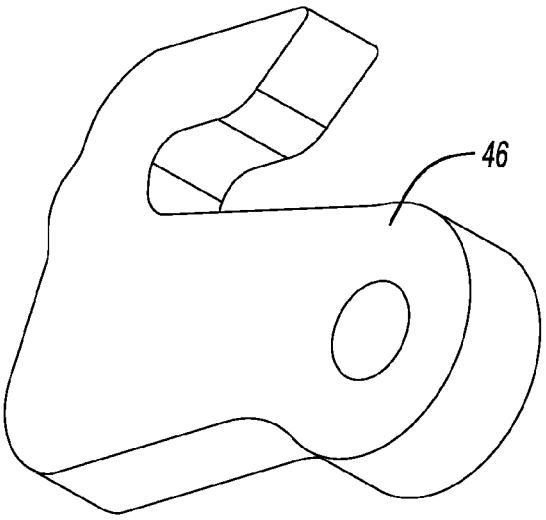

FIGS. 13A-13C represent a version of the rotatable locking feature 46. The locking feature is a hook member having a surface which engages the aperture in the window frame. Also shown is a bump 102 which engages a lock 37 in the sash support 32 which holds the hook in an undeployed position. Additionally, the rotatable locking feature 46 can have a defined center of gravity C, which allows for the rotation of the locking member into the frame under the force of gravity.

FIG. 14 depicts a window assembly according to the present teachings. Disposed within the window jamb is at least one movable sash, and associated sash support 32. As described above, there is shown a window assembly. The window assembly has a frame 22 which slidably supports a sash. To prevent the effects of gravity on the sash, a spring counter balance 20 is provided. The spring counter balance 20, which is shown in a retracted position, is coupled to the window frame 22 and provides forces to support the sash.

The spring counter balance 20 is positioned within the frame 22, being fixably coupled to a first bearing surface 24. In this regard, a portion of the spring counter balance 20 is positioned within a carrier aperture 41 defined within the first bearing surface 24. The spring counterbalance 20 can be fixed within the aperture 41 using flanges and/or one or more fasteners.

The spring housing 30 is positioned with the carrier aperture 41, functions to couple the spring 38 to the first bearing surface 24 and, as described below, has features to facilitate the coupling and reduce the profile of the spring counter balance 20. A portion of the spring 38 can rotate within the housing on a curved bearing surface to allow extraction of the spring during movement of the sash. As the sash moves within the frame, the extracted portion of the spring 38 travels with the sash. In this regard, the spring and sash travel proportionally, so there is no longitudinal relative movement of the spring 38 with respect to the sash. This significantly reduces the amount of friction between the components and reduces the amount of damage which may be caused by movement of the spring 38.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A window balance assembly for a window frame, comprising:

a spring member having first and second portions;

a spring module including a housing containing the first portion of the spring member, the housing having a first engagement feature disposed at a first end thereof and being configured to engage a first aperture defined by the window frame and attach the spring module thereto, and a second engagement feature disposed at a second end thereof opposite the first end; and a carrier module coupled to the second portion of the spring member, the carrier module being configured to support a portion of a window sash and comprising third and fourth engagement features, the third engagement feature being selectively connectable with the second engagement feature to releasably connect the carrier module directly to the housing, and the fourth engagement feature being configured to selectively engage the window frame so as to preclude movement of the carrier module in the window frame.

2. The window balance assembly of claim 1, wherein the fourth engagement feature is a rotatable hook configured to selectively engage a second aperture defined by the window frame.

3. The window balance assembly of claim 1, wherein the fourth engagement feature is a selectively deformable u-shaped deformable member configured to selectively engage first and second side bearing surfaces of the window frame.

4. The window balance assembly of claim 3, wherein the fourth engagement feature includes a rotatable member adapted to apply forces to a portion of the u-shaped member to translate a portion thereof into engagement with the first and second side bearing surfaces of the window frame.

5. A method of installing a window balance assembly of claim 1 comprising:

attaching the spring module to the window frame by engaging the first engagement feature of the spring module with the with the first aperture defined by the window frame;

releasably connecting the carrier module to the spring module;

engaging the window frame with the fourth engagement feature of the carrier module so as to preclude movement of the carrier module in the window frame; and supporting a portion of the window sash on the carrier module.

6. A window balance assembly for installation into a window frame and for supporting a window sash moveable within a jamb channel of the window frame comprising:

a curl spring member having a first coiled portion;

a housing attached to the window frame and containing the first coiled portion of the curl spring member, the housing installed within a first aperture in a surface of the jamb channel of the window frame such that only a portion of the first coiled portion of the curl spring member is positioned within the jamb channel, the housing comprising a first engagement feature disposed on a first surface of the housing and engaging the first aperture;

a carrier member coupled to a second end portion of the curl spring member that extends from the housing, the carrier member comprising a sash support for engaging the window sash and a locking feature movable between a disengaged position where the carrier member is operable to move within the jamb channel of the window frame and an engaged position where the carrier member is inoperable to move within the jamb channel of the window frame; and a locking connection between the housing and the carrier member that removably attaches the carrier member to the housing.

7. The window balance assembly of claim 6 wherein the locking connection comprises at least one outwardly extending protrusion on a lower portion of the housing and a receptacle portion at an upper end of the carrier member that engages the protrusions.

8. The window balance assembly of claim 7 wherein the locking connection further comprises a second aperture configured to receive a fastener for attaching the carrier member to the housing.

9. The window balance assembly of claim 6 wherein the first engagement feature comprises a plurality of flanges extending from the first surface of the housing.

10. The window balance assembly of claim 6 wherein the locking feature comprises one of a rotatable hook and a selectively deformable u-shaped member that engages a channel forming surface of the window frame.

11. The window balance assembly of claim 10 wherein the carrier member further comprises an engagement surface that interlocks with the rotatable hook to hold the hook in the disengaged position.

12. The window balance assembly of claim 10 wherein the locking feature comprises a rotatable member adapted to apply forces to a portion of the u-shaped member to translate a portion thereof into the window frame.

13. The window balance assembly of claim 10 wherein the locking feature selectively engages a second aperture in the surface of the jamb channel.

14. The window balance assembly of claim 6 wherein the carrier member comprises a slot having a projection adapted to receive and retain the second end portion of the curl spring.

15. The window balance assembly of claim 6 wherein the housing further comprises a support surface configured to bear against the jamb channel when the spring housing is coupled to the window frame.

16. The window balance assembly of claim 6 wherein the housing comprises a curved ramp surface that facilitates rotation of the curl spring within the housing during extraction or retraction of the curl spring.

17. The window balance assembly of claim 6 further comprising a plurality of curl spring members, each having a respective first coiled portion; and wherein the housing contains each first coiled portion of the plurality of curl spring members and rotatably supports each first coiled portion therein.

18. The window balance assembly of claim 17 wherein the plurality of curl springs are coupled together.

19. A window balance assembly for installation into a window frame and for supporting a window sash moveable within a jamb channel of the window frame comprising:

a curl spring member having a first coiled portion;

a housing rotatably supporting the first coiled portion of the curl spring member and being adapted for installation within a first opening in a wall of the jamb channel of the window frame such that a portion of the first coiled portion of the curl spring member is positioned within the jamb channel;

a carrier member coupled to a second end portion of the curl spring member that extends from the housing, the carrier member comprising a sash support adapted for engaging the window sash and a hook adapted to engage a second aperture in the surface of the jamb channel to prevent the carrier member from moving within the jamb channel of the window frame;

the housing comprising an outwardly extending protrusion on a lower portion thereof; and the carrier member comprising a receptacle portion at an upper end thereof that engages the protrusion to releasably attach the carrier member directly to the housing.

20. The window balance assembly of claim 19 wherein the housing further comprises a plurality of flanges extending from the first surface of the housing being adapted for engaging the first aperture.

21. The window balance assembly of claim 19 wherein the carrier member further comprises an engagement surface that interlocks with the hook to retain the hook in a position where it does not engage a second aperture in the surface of the jamb channel.

22. A method of installing a window balance assembly of claim 19 comprising:

inserting the housing into the first opening in the wall of the jamb channel;

detaching the carrier member from the housing; and supporting the window sash with the sash support.

23. The method of claim 22, further comprising fixing the housing to the jamb channel with a fastener.

24. The method of claim 22, wherein detaching the carrier member from the housing includes disconnecting the protrusion from the receptacle portion.

25. The method of claim 22, further comprising engaging the hook with the second aperture and preventing the carrier member from moving within the jamb channel.

26. The method of claim 22, further comprising engaging the hook with the second aperture in the surface of the jamb channel.

* * * * *